United States Patent [19]

Polcyn

[11] Patent Number: 4,795,180

[45] Date of Patent: Jan. 3, 1989

[54] TOOL CADDY

[76] Inventor: Jeffrey Polcyn, P.O. Box 250 -- Rte. #4, Gallipolis, Ohio 45631

[21] Appl. No.: 25,643

[22] Filed: Mar. 13, 1987

[51] Int. Cl.[4] ..... B65D 85/00

[52] U.S. Cl. ..... 280/79.1 A; 206/373; 280/32.6; 312/DIG. 33

[58] Field of Search ..... 280/32.6, 79.1 R, 79.1 A; 206/45, 45.18, 372, 373, 349; 312/DIG. 33

[56] References Cited

U.S. PATENT DOCUMENTS

| | | | |
|---|---|---|---|
| D. 152,008 | 12/1948 | Lucas | 280/32.6 |
| 599,753 | 3/1898 | Whittle | 206/45 |
| 1,104,398 | 7/1914 | Zimmerman | 280/32.6 |
| 1,238,074 | 8/1917 | Labadie et al. | 206/45 |
| 1,761,331 | 6/1930 | Dewey | 206/372 |
| 2,291,094 | 7/1942 | McCarthy | 280/32.6 |
| 2,475,266 | 7/1949 | Williams | 280/32.6 |
| 2,525,208 | 10/1950 | Clink | 206/373 |
| 3,301,619 | 1/1967 | Mead | 206/373 |
| 3,339,938 | 9/1967 | Edmission | 280/79.3 |
| 3,677,569 | 7/1972 | Larson | 280/32.6 |
| 3,878,939 | 4/1975 | Wilcox | 206/373 |
| 4,266,835 | 5/1981 | Schmidt | 312/DIG. 33 |
| 4,319,683 | 3/1982 | Correa | 206/372 |
| 4,389,077 | 6/1983 | Schmidt | 312/DIG. 33 |
| 4,471,969 | 9/1984 | Zabala | 280/32.6 |

*Primary Examiner*—Richard A. Bertsch

*Attorney, Agent, or Firm*—Anthony D. Cennamo

[57] ABSTRACT

A tool caddy for use with a conventional workman's creeper by a workman in upright inaccessable places. The construction of the tool caddy comprises a rectangular box-like housing or top and bottom complimentary halves; each half has an elongated side wall greater in height than the elongated side wall of the other half. The top complimentary half is removable by snap-on fasteners on opposite edges joining the pair of side walls. With the top half removed the tool tray positioned in the bottom half is at an angle realtive to the bottom side of the tool caddy. One elongated side has spacers or the like, positioned on the outside thereof to maintain the tool caddy in an upright position without contact to the floor when not in use; and the opposite side, on the outside thereof, includes a handle for portability of the entire structure. On the bottom of the opposite side to the removable side has positioned thereon a plurality of creeperlike wheels. The tool tray is in compartments to maintain the tools in a functional position. Auxliary apparatus such as an electrical system is included.

8 Claims, 1 Drawing Sheet

TOOL CADDY

BACKGROUND OF THE INVENTION AND PRIOR ART

Creepers to assist a mechanic by providing a comfortable sliding surface beneath an automobile or some inaccessable place to an upright mechanic, are well known in the prior art and have found extensive use. The creepers do provide an improved working relationship between the mechanic and the workpiece by permitting movement of the mechanic; but yet, maintains the mechanic's body above the ground or floor. The prior art creepers have been modified in many ways to improve the inconvenience and comfort of the mechanic.

In U.S. Pat. Nos. 1,104,398 and 2,291,094 the appendages to retain tools for the mechanic. Although the expedient is a step forward, the use of such structures has not been accepted extensively—for many and obvious reasons.

Initially, tools to a mechanic is the equivalent of a bible to a clergyman, law books to a lawyer, or a stethoscope to a physician. Substantially every mechanic has his own tools; tools that he preciously guards and cares for; and naturally, a tool chest for maintaining the tools in proper order and the such.

In most underneath the auto mechanical service, the mechanic will select from his tool chest the desired tools, use a creeper to "scoot" on the floor and place the tools adjacent the creeper on the floor. Movement of the mechanic beneath the auto causes his tools to be displaced and inaccessable to the reach; and additionally becoming dirty and greasy. Simply, the primary advantage of a creeper to move about beneath the auto has been defeated.

SUMMARY OF THE INVENTION

The present invention provides a tool caddy that permits a mechanic to maintain his tools in a typically neat professional tool chest, but yet, he can utilize the tools without prior removal from the tool caddy. Further, while beneath an auto or the like, the mechanic's tools are handly and readily at his grasp. Movement of the creeper is accompanied by a movement of the tool caddy; but, without disturbing the tool arrangement.

Generally, the tool caddy creeper of the present invention is a rectangular box of a size or sizes related to the work function of the mechanic. In a preferred embodiment, the tool caddy is in compartments to accommodate specified tools. The number and size will dictate the size of the tool caddy.

The tool caddy has fixedly positioned, in a spatial relationship, on the outside of the bottom panel a plurality of creeper wheels. In this way the mechanic having his back side resting on a creeper will have at his disposal his tools familiarly placed in a tool caddy. The mechanic's movement beneath the workpiece is readily followed by a similar movement of the tool caddy.

The preferred embodiment further comprises having the flat side opposite the bottom side with the wheels, a top or cover for closing and securing the tool caddy. Although the overall structure is a rectangular box when closed, the tool caddy when open has a tray that is at an angle relative to the workman's creeper. In this way the tools are within sight of the mechanic. Movement of the tool caddy does not alter the position of the tools in the tray.

In a sophisticated preferred embodiment, the rectangular box comprises a top and bottom complimentary halves. The lower half comprising the tool caddy and the top half the cover. The one side panel of each of the complimentary halves has a height substantially greater than the other opposite elongated side panel. When the top and the bottom halves are merged, the greater height panel of the top half is joined with the lesser height of the bottom half. The lower half encompassing the tool tray will maintain the tool tray at an angle relative to the caddy. The top half further includes grommet/spacers on one side and on the opposite side a handle for ease of carrying the tool caddy from one place to another.

OBJECTS OF THE INVENTION

It is a principal object of the present invention to provide a tool caddy having the same movement in upright unaccessible places as that of a conventional creeper.

Another object of the present invention is to provide such a tool caddy for positionally maintaining mechanic's tools; but yet, affords accessability to the tools by the mechanic without removal from the caddy.

A further object of the present invention is to provide a tool caddy that is completely enclosed within a housing with means attached for portability and opening into an accessable tool tray to a mechanic in a work position on a mechanic's creeper.

Still another object of the present invention is to provide such a tool caddy that permanently maintains specialized tools in a fixed relationship, and at an angle to be visible to a mechanic in a prone position on a mechanic's creeper.

Other objects and features of the present invention will become apparent from the following detailed description of the invention in its preferred embodiment when taken in conjunction with the several figures in the drawings in which:

DETAILED DESCRIPTION OF THE INVENTION IN A PREFERRED EMBODIMENT

Figure 1:
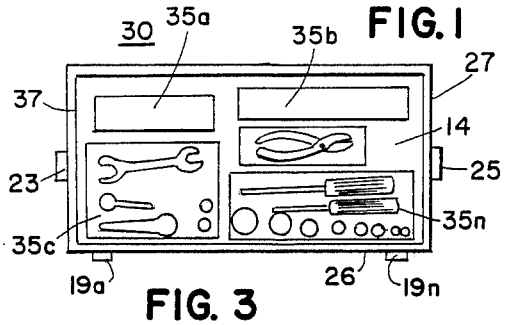
FIG. 1 is a top view of the preferred embodiment of the invention with the top complimentary half removed.

With reference to the several figures in the drawings, there is illustrated the tool caddy of the present invention in a preferred embodiment. The tool caddy is structured to permanently maintain a mechanic's tools in a fixed position in the caddy even though the mechanic utilizing the tools is in a prone position on a conventional creeper. Most significantly, as the mechanic moves or changes position beneath the workpiece, the tool caddy is similarly movable without disturbing the tool arrangement. But yet, the tool caddy when not in use is closed into a rectangular box-like structure with means for readily transporting the tool caddy to other work areas.

The overall structure comprises a pair of complimentary halves; bottom half 45 and top half 55. The bottom half being the tool caddy and the top half 55 being the cover for the tool caddy.

The bottom half 45 comprises bottom panel 14, side panels 27 & 37, secured to the bottom panel 14 and elongated panels 16 & 26 secured to the bottom panel 14 and to the side panels 27 & 37; whereas the top half 55 comprises top panel 12, side panels and the opposite mirror side panel 17 secured to the top panel 12 and elongated panels 05 & 15 secured to the top panel 12 and to the side panels and the opposite mirror side panel 17.

As can be envisioned from FIGS. 1, 5, 8, & 9, the elongated panels 05 of the top half 55 and 16 of the bottom half 45 are substantially less in height than the elongated panel 26 of the bottom half 45 and elongated panel 15 of the top half 55. This in turn, in complimentary relationship have side panels 27& 37 of the bottom half 45 and side panels and the opposite mirror side panel 17 of the top half 55 of matching heights (panel 07 not shown, mirror image of panel 17 and oppositely positioned).

Figure 5:
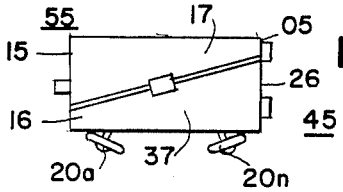
FIG. 5 is a side view of the tool caddy in a closed position for portability.
Figure 6:
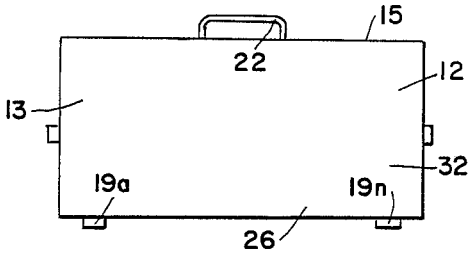
FIG. 6 illustrates in a top view the removable upper portion of the tool caddy.

As can be seen from FIG. 5, and also appreciated the side panels of the top half 55 and of the bottom half 45 do not comprise a uniform dimension. That is, the one end matches the height of the major height elongated panel and the other end matches the minor height elongated panel. Simply, the side panels 27 & 37 and 05 & 15 taper from one edge to the other with the elongated panels joining the edges with a complimentary height.

With continued reference to FIG. 5, the upper half structure 55 is the mirror image of that of the bottom half 45 and when superimposed on one another, as shown in FIG. 5 the ensuing structure is a rectangular box-like structure 10.

Now referring to FIGS. 2, 3, 4, & 7, the tool caddy of the preferred embodiment is a closed compact structure for ease of portability and for toting from one area to another. The top panel 12 of the upper half 55 is now the side panel of the upright structure; whereas the bottom panel 14 of the lower half is now the other side panel of the upright structure.

Figure 7:
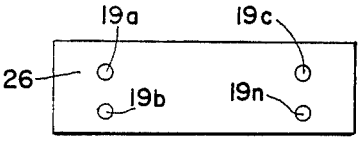
FIG. 7 illustrates the side panel comprising the grommet/spacers positioned on the one side panel.

The upper half 55 and the lower half 45 of the two part structure are secured by way of snap-type locks or similar means 23 & 25. In the upright position as shown in the aforesaid figures, there is included a plurality of spacers 19*a* xxx 19*n* spatially placed on the elongated panel 26, now the bottom panel, as shown in FIG. 7 specifically. On the opposite end, elongated panel 16 now top panel, there is included a handle 22 for ease of carrying the tool caddy from one work area to another.

Figure 2:
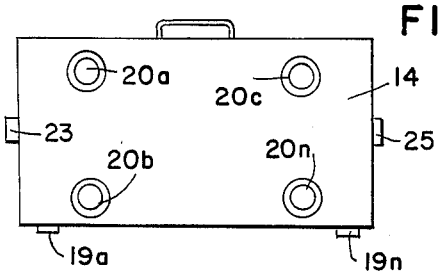
FIG. 2 is a bottom view of the embodiment of FIG. 1 and illustrates the spatially positioned creeper wheels on the bottom panel of the lower complimentary half.
Figure 3:
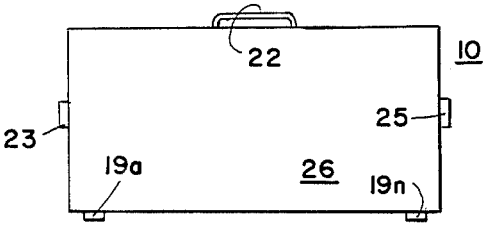
FIG. 3 is an upright view of the tool caddy with the top complimentary half in position over the lower complimentary half and illustrating the support grommet/-spacers and handle for portability of the tool caddy when not in use as creeper.
Figure 4:
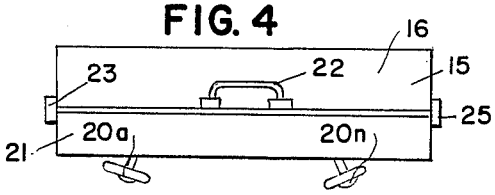
FIG. 4 is a top view of the tool caddy of FIG. 1 illustrating the handle for portability when the structure is in a closed position.

The bottom panel 14 of the lower half 45, the upright half as shown in FIG. 2, further comprises a plurality of creeper-like wheels 20*a* xxx 20*n* spatially positioned thereon. As aforementioned, when the tool caddy is opened for use of the tools therein by a mechanic in a work environment, the tool caddy is movable from one position to another much in the same manner as the creeper upon which the mechanic rests his body.

Figure 8:
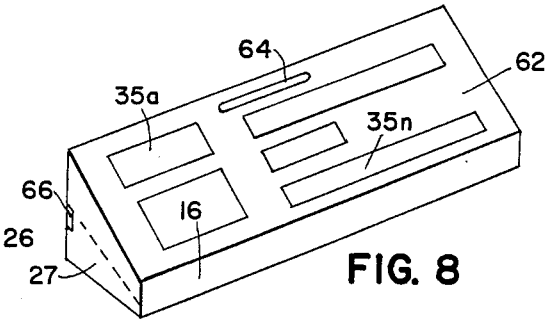
FIG. 8 illustrates the tool tray positioned at an angle and in view of the mechanic in an open position.
Figure 9:
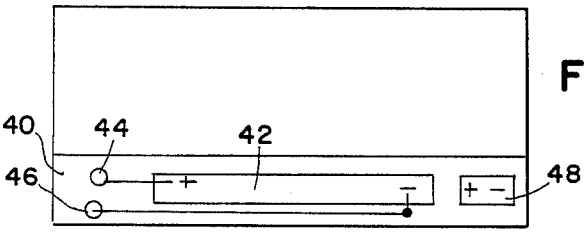
FIG. 9 illustrates the battery compartment of the tool caddy and the permanent plug for a light.
Figure 10:
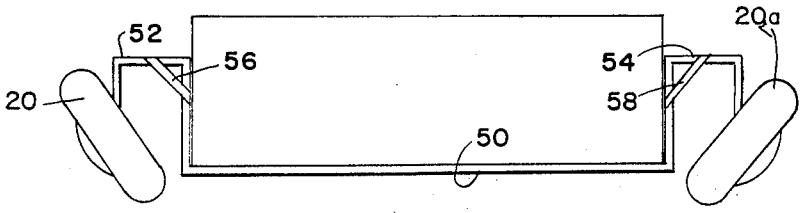
FIG. 10 illustrates recessed wheels on the tool caddy to provide a greater height of the tool carrying portion.

As shown in FIGS. 1 and 8, when the tool caddy is opened, that is with the upper half 55 removed, the tool tray 62 has the tools positioned therein in several compartments 35*a* xxx 35*n*. Also to be noted, and in conformance to the above description of the complimentary halves, the tool tray 62 does not rest horizontally flat within the caddy. The tool tray 62 is at an angle relative to the bottom panel 14. It must be appreciated that a mechanic in a prone position beneath an auto or workpiece cannot raise his head to look into his tool box; therefore, the tool tray is at an angle to permit the mechanic to see all of the tools in the tool tray 62 without raising his head.

The tool tray 62 has its forward end, in a removable unit, abuted against the front elongated panel 16; whereas the uppermost portion of the lower half 45 has a shelve/shoulder 66 for supporting the rear portion of the tray 62. In an alternative arrangement the tray 62 is not a separate unit but is integrated into the tool caddy as a permanent part thereof.

Other arrangements of the tool tray relative to the bottom half 45 wherein the tool tray is displayed for the convenience of the mechanic is within the scope of the preferred embodiment.

To utilize the available space within the tool caddy 10, and to enhance the utility thereof, the back portion of the lower half 45 has included therein an array of batteries or an enlargend battery of the proper voltage and current. A plate 40 is positioned in the elongated panel 16. Connected to the plate 40 by way of electrical wires are the batteries 42; this provides a voltage/current outlet for an electrical appliance such as a spot light for use by the mechanic or a battery operated tool such as a drill.

A smaller battery 48 is also positioned in the back space as aforesaid. This battery 48 has connected thereto pilot light 64 positioned on the tool tray 62. The spot light and the pilot light are conventional in design and per se do not form a part of the invention.

In certain applications it may be desired that the tool caddy 10 have a height sufficiently large to accommodate large size tools. Such a need would require a tool caddy of a height greater than that hereintofore described. In those instances, the wheels 20*a* xxx 20*n* are positioned on the outside of the tool caddy by angle brackets 52 and 5 respectively having reinforcements 56 and 58. In this way only the very tip of the wheels engage the floor with the remaining portion of the wheels at an elevated position. The depth of the wheels is now part of the tool caddy The interior of the tool tray 62 comprises compartments 35 xxx 35*n*, specifically designed to position and retain the specialized tools and instruments for the convenience of the mechanic.

In a specific utilitarian function, the overall tool caddy structure 10 is taken to the worksight. The tool caddy is placed flat on the floor or ground with the wheels 20*a* xxx 20*n* beneath the tool caddy and in contact with the floor or ground. The cover upper half 55 is removed by unfastening snap locks 23 and 25. The mechanic positions himself on a conventional creeper and moves to a work position relative to the workpiece. Similarly, the tool caddy creeper is moved to a place adjacent the mechanic's creeper for ready access of the tools for use by the mechanic in the service operation. Upon completion of the service function the tool caddy is removed from the workpiece, the upper cover 55 placed over the bottom half 45; and the locks 23 and 25 secured to join the two halves. The handle 22 is grasped and the tool caddy is raised into an upright position with the spacer/grommets engaging the floor. The tool caddy 10 is now ready for toting to another worksight.

Although specific embodiments are shown and described in the specification and drawings, it is to be understood that modifications and alternatives may be had without departing from the spirit and scope of the invention.

I claim:

1. A tool caddy for use by a workman with a conventional creeper of the like for working in upright inaccessable work places, comprising:

a rectangular box-like structure comprised of complimentary halves, each having a bottom panel, a pair of side panels, and a pair of end walls, the width and depth dimension of said complimentary bottom panels being substantially greater that the maximum height dimension of said complimentary side walls and said complimentary end walls, said complimentary pair of said walls further comprising a front and rear wall and wherein each of said rear side walls having a greater height dimension than that of said complimentary side walls, and wherein each of said pair of end walls have a front to rear height matching the height of said front and rear end walls, and wherein said front and rear end walls of each of said complimentary half structures are substantially identical in height;

a tool tray positioned in one of said complimentary half structures at an angle from the flat horizontal to that of the front and rear heights of said end walls, a plurality of wheels spatially positioned on the outside of said bottom panel of said half structure having said tool tray positioned therein; and wherein said complimentary half of said rectangular box-like structure not having said tray positioned therein is fixedly secured over said half having said tray positioned therein.

2. The tool caddy of claim 1 further comprising a pair of engaging locks for securing together said pair of complimentary half structures.

3. The tool caddy of claim 2 wherein said end wall having the major height of said complimentary half structures not having said tray positioned therein, further comprising a plurality of spacers spacially positioned on the outside thereof.

4. The tool caddy of claim 3 wherein said major height end wall opposite to that of said last named major height side wall further comprises a handle fixedly positioned thereon.

5. The tool caddy of claim 1 wherein said tool tray further comprises compartments formed therein.

6. The tool caddy of claim 1 further comprising a direct current electrical source positioned in said complimentary half structure below said tool tray at the maximum height thereof.

7. The tool caddy of claim 6 wherein said structure further comprises an electrical outlet and means for connecting said direct current source to said electrical outlet.

8. The tool caddy of claim 1 wherein said complimentary half structure having said creeper wheels spatially positioned thereon, further including side brackets for positioning said creepers, and wherein said side brackets are of a height slightly less that the height of said creepers.

* * * * *